United States Patent [19]

Drosdziok et al.

[11] 4,437,898

[45] Mar. 20, 1984

[54] METHOD AND AGENT FOR PASSIVATING IRON AND STEEL SURFACES

[75] Inventors: Hermann Drosdziok; Jürgen Geke, both of Dusseldorf; Hans G. Germscheid, Ratingen, all of Fed. Rep. of Germany

[73] Assignee: Henkel Kommanditgesellschaft auf Aktien, Dusseldorf-Holthausen, Fed. Rep. of Germany

[21] Appl. No.: 369,022

[22] PCT Filed: Aug. 19, 1981

[86] PCT No.: PCT/EP81/00128

§ 371 Date: Apr. 5, 1982

§ 102(e) Date: Apr. 5, 1982

[87] PCT Pub. No.: WO82/00665

PCT Pub. Date: Mar. 4, 1982

[30] Foreign Application Priority Data

Aug. 27, 1980 [DE] Fed. Rep. of Germany ..... 3032226

[51] Int. Cl.[3] ..... C23F 7/08

[52] U.S. Cl. ..... 148/6.15 R; 106/14.12; 106/14.15; 252/389 R; 252/390; 252/396

[58] Field of Search ..... 148/6.15 R; 252/389 A, 252/390, 366; 106/14.12, 14.15

[56] References Cited

U.S. PATENT DOCUMENTS

| | | | |
|---|---|---|---|
| 2,790,779 | 4/1957 | Spivack et al. | 106/14.12 |
| 3,368,913 | 2/1968 | Ziehr et al. | 148/6.15 R |
| 4,045,253 | 8/1977 | Banks et al. | 148/6.15 R |
| 4,276,089 | 6/1981 | Moran | 106/14.12 |

*Primary Examiner*—Michael R. Lusignan
*Assistant Examiner*—Janyce A. Bell
*Attorney, Agent, or Firm*—Hammond & Littell, Weissenberger and Muserlian

[57] ABSTRACT

The metal surfaces are treated with 0.5 to 5 wt. % aqueous solutions (pH value 7.5 to 10.5), in which is contained a synergistic combination—giving a clear solution in water—of corrosion-inhibiting substances. The combination consists of:

a. one or more maleic acid mono-n- or -iso-alkylamides with 6 to 14, preferably 8 to 10 C atoms,
b. one or more alkalolamines, preferably mono-, di- and/or tri-ethanolamine, and
c. complexing phosphonic acids, preferably 1-hydroxy-alkyl-1,1-diphosphonic acid, 1-aminoalkyl-1,1-diphosphonic acid, phosphonocarboxylic acid and/or a phosphonic acid of the formula:

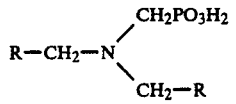

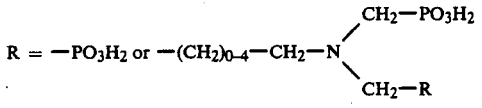

Preferred phosphonic acids are 1-hydroxyethane-1,1-diphosphonic acid, 2-phosphonobutane-1,2,4-tricarboxylic acid and/or nitrilotrimethylene-phosphonic acid.

The weight ratio of a:b should be in the solutions 1:0.3 to 1:10, that of a:c, 1:0.01 to 1:0.5. The solutions can contain additionally surfactants, preferably non-ionogenic surfactants in small quantities, also builders, preferably phosphates and/or borates.

14 Claims, No Drawings

METHOD AND AGENT FOR PASSIVATING IRON AND STEEL SURFACES

The invention relates to a method and agent for passivating iron and steel surfaces chemically with the aid of aqueous solutions which give a weak alkaline reaction and contain a combination of certain corrosion inhibiting substances.

It is often necessary to passivate iron and steel surfaces in order to avoid undesirable corrosion phenomena. This is done for example in or after cleaning operations, in metal fabricating or intermediate storage before further fabricating of the metals. Also, passivating agents are used as additives to mold release baths, quenching water, as for example in induction hardening, in cooling cycles, as in motor test stands, and also as hydraulic fluids.

A number of methods are known for passivating. Thus it can be effected for example with oils or greases or also with corresponding synthetic emulsions, although then often undesirable films will form. It is therefore often expedient to passivate the metal surfaces with aqueous solutions which contain appropriate chemical additives. Such corrosion-inhibiting passivation agents for iron surfaces are for example alkali metal nitrites, alkali metal chromates, soaps, benzoates and alkanolamines. Also maleic acid mono-isoalkylamides have been employed for the passivation of iron and steel surfaces.

It has now been found, surprisingly, that with respect to corrosion protection a strong synergistic action occurs when use is made of the method described below for chemically passivating iron and steel surfaces with the aid of aqueous solutions which give an alkaline reaction and contain a combination of certain corrosion inhibiting substances.

The new method is characterized in that the metal surfaces are treated with 0.5 to 5 weight-percent solutions, whose pH value is between 7.5 and 10.5 and which contain a combination, giving a clear solution in water, of (a) one or more maleic acid monoalkylamides, (b) one or more alkanolamines, (c) one or more phosphonic acids which have complexing properties, the weight ratio maleic acid monoalkylamide to alkanolamine being 1:0.3 to 1:10 and the weight ratio maleic acid monoalkylamide to phosphonic acid, 1:0.01 to 1:0.5.

As maleic acid monoalkylamides may be used amides with straightchain as well as branched alkyl radicals with 6 to 14 carbon atoms, preferably with 8 to 10 carbon atoms.

As suitable alkanolamines may be used short-chain compounds such as mono-, di- and tri-isopropanolamine, n-propanolamine, N,N,N',N'-tetrakis-(2-hydroxyethyl) ethylene diamine, and preferably mono-, di- and tri-ethanolamine, in particular as a mixture.

As suitable complexing phosphonic acid may be named: 1-hydroxyalkyl-1,1-di-phosphonic acid, 1-amino-alkyl-1,1-diphosphonic acid, phosphonocarboxylic acid, as in particular 2-phosphono-1,2,4-tricarboxylic acid, and/or phosphonic acids of the general formula

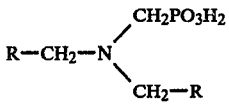

in which

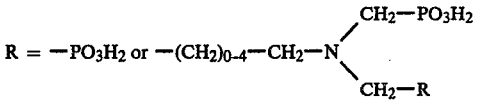

Preferably 1-hydroxyethane-1,1-diphosphonic acid, 2-phosphonobutane-1,2,4-tricarboxylic acid and nitrilotrimethylene phosphonic acid have proved successful. The phosphonic acids can be employed also, incidentally, as alkali metal salts or alkanolamine salts. Alternatively the free phosphonic acids may be added to the respective solutions. In such a case, using an excess of alkanolamine in the solution, the latter can be adjusted to the pH value of 7.5 to 10.5.

An essential feature of the combination according to the invention is the weight ratio of maleic acid monoalkylamide to alkanolamine, which should be 1:0.3 to 1:10 and preferably 1:1 to 1:4. The weight ratio of maleic acid monoalkylamide to phosphonic acid is in the method of the invention 1:0.01 to 1:0.5 and preferably 1:0.1 to 1:0.5. While it is possible to increase the phosphonic acid addition further, it gives no additional synergistic effects.

If the pH value of the solution of 7.5 to 10.5 suitable for the practice of the method is not already achieved by the alkalinity of the substances used, it can be adjusted by a slight addition of alkali.

The treatment of the metal surfaces of iron or steel can be effected at elevated temperatures between 30° and 100° C., but preferably at room temperature.

Besides the components already mentioned, the agents may contain other substances as well. For this enter consideration in particular surfactants, preferably nonionic low-foam surfactants, especially when simultaneously with the passivation a cleaning operation is desired or greased or partially greased parts are to be treated simultaneously in one operation.

As low-foam nonionic surfactants may be named: The addition products of ethylene or propylene oxide to polypropylene glycol or respectively polyethylene glycol as well as addition products of ethylene and/or propylene oxide to mono- or poly-alcohols, mono- or poly-amines, fatty acids, amides and alkyl phenols with an alkyl radical of preferably 8 to 20, in particular 12 to 18 carbon atoms.

If surfactants are used, the concentration in the aqueous passivating solution is between 0.005 and 0.3 percent by weight.

Lastly, in some cases, it may be desirable also to add to the agents of the invention so-called builders, which intensify the action of the surfactants, to increase the cleaning action. In particular ortho- or polymer phosphates and/or borates should be named. The preferred builder content is 0.2 to 2 percent by weight, based on the aqueous solution. The agents according to the invention may further contain alkanolamine soaps of short-chain fatty acids—i.e. fatty acids with 6 to 12 carbon atoms—for example caprylic or isononanoic acid, which in a manner known in itself intensify the anticorrosion action and act as solubilizer and also as foam regulator. Further the solutions according to the invention may optionally contain preservatives to prevent bacterial decomposition, as for example chlorophenols, diphenyl derivatives, hexahydrotriazone derivatives, and/or for nonferrous metal inhibition benzotriazole, mercaptobenzotriazole and lignin sulfonate in quantities of about 0.05 to 0.1 percent by weight.

The agents being used contain the named components in the stated quantities. If desired, however, the respective agents may be produced in concentrated form, in order to be diluted to the named concentration just before use.

The corrosion protection obtained with the solutions of the invention is considerably better than the sum of the properties of the single substances and is superior to the passivating agents used until now.

EXAMPLES

The excellent anticorrosive properties of the method according to the invention were tested in the Anticorrosion Test per DIN 51 360/2 with cast iron chips GG 30 at exposure times of 2 hours. The test solutions were formulated with hard water of 20° German hardness at room temperature. The pH value of all test solutions was between 8.5 and 10.5; the test and comparison solutions were adjusted to the same pH value. The concentration of the respective combination was in the DIN tests 1, 1.5 and 2%. The table lists under (a) the comparison tests, under (b) the solutions of the invention.

10. Active substances of the formulation in parts by weight
    10 Boric acid
    5 Monoethanolamine
    6.6 Maleic acid mono-2-ethylhexylamide
    20 Diethanolamine
    3.3 Caprylic acid
    2 1-Hydroxyethane-1,1-diphosphonic acid
    1.3 nonionic surfactant (product of addition of ethylene oxide to polyethylene glycol)

Corrosion test according to DIN 51 360/2
Evaluation of rust formation in corrosion degrees 0–4
0 = no corrosion, 4 = strong corrosion

| Combination | Concentration of the test solutions in % corrosion degree after 2 hours | | |
|---|---|---|---|
| | 1 | 1.5 | 2 |
| 1. a | 4 | 4 | 4 |
| b | 3 | 1 | 0 |
| 2. a | 2 | 1 | 0 |
| b | 0 | 0 | 0 |
| 3. a | 2 | 1 | 0 |
| $b_1$ | 0–1 | 0 | 0 |
| $b_2$ | 1 | 0 | 0 |
| 4. a | 2 | 1 | 0 |
| $b_1$ | 0 | 0 | 0 |
| $b_2$ | 1 | 0 | 0 |
| 5. a | 1–2 | 0 | 0 |
| b | 0 | 0 | 0 |
| 6. a | 2–3 | 2 | 1 |
| b | 1 | 0 | 0 |
| 7. a | 4 | 3 | 3 |
| b | 2 | 0 | 0 |
| 8. | 1 | 0 | 0 |
| 9. | 0 | 0 | 0 |
| 10. | 2 | 0 | 0 |

| Combinations | | | |
|---|---|---|---|
| 1. | (a) | Maleic acid mono-n-hexylamide:Diethanolamine | 1:3 |
| | (b) | Maleic acid mono-n-hexylamide:Diethanolamine:1-Hydroxyethane-1,1-diphosphonic acid | 1:3:0.15 |
| 2. | (a) | Maleic acid mono-n-octylamide:Diethanolamine | 1:3 |
| | (b) | Maleic acid mono-n-octylamide:Diethanolamide:Hydroxyethane-1,1-diphosphonic acid | 1:3:0.15 |
| 3. | (a) | Maleic acid mono-2-ethyl-hexylamide:triethanolamine | 1:3 |
| | ($b_1$) | Maleic acid mono-2-ethyl-hexylamine:triethanolamine:1-Hydroxyethane-1,1-diphosphonic acid | 1:3:0.25 |
| | ($b_2$) | Maleic acid mono-2-ethyl-hexylamide:triethanolamine:Aminotrimethylenephosphonic acid | 1:3:0.2 |
| 4. | (a) | Maleic acid mono-2-ethyl-hexylamide:Diethanolamine | 1:3 |
| | ($b_1$) | Maleic acid mono-2-ethyl-hexylamide:Diethanolamine:1-Hydroxyethane-1,1-diphosphonic acid | 1:3:0.15 |
| | ($b_2$) | Maleic acid mono-2-ethyl-hexylamide:Diethanolamine:Phosphonobutane-tricarboxylic acid | 1:3:0.15 |
| 5. | (a) | Maleic acid mono-2-ethyl-hexylamide:Monoethanolamine | 1:1 |
| | (b) | Maleic acid mono-2-ethyl-hexylamide:Monoethanolamine:1-Hydroxyethane-1,1-diphosphonic acid | 1:1:0.12 |
| 6. | (a) | Maleic acid mono-n-decylamide:Diethanolamine | 1:3 |
| | (b) | Maleic acid mono-n-decylamide:Diethanolamine:1-Hydroxyethane-1,1-diphosphonic acid | 1:3:0.15 |
| 7. | (a) | Maleic acid mono-n-tetradecylamide:Triethanolamine | 1:3 |
| | (b) | Maleic acid mono-n-tetradecylamide:Triethanolamine:1-Hydroxyethane-1,1-diphosphonic acid | 1:3:0.12 |

8. Active substances of the formulation in parts by weight
    10 Monoethanolamine
    10 Diethanolamine
    10 Triethanolamine
    5 Maleic acid mono-2-ethylhexylamide
    2 Maleic acid monodecylamide
    7 Caprylic acid
    1 1-Hydroxyethane-1,1-diphosphonic acid, 60%
    1 Aminotrimethylene phosphonic acid, 50%
    2 nonionic surfactant (product of addition of ethylene oxide to polyethylene glycol)
    1 Phosphonobutane tricarboxylic acid, 50%
9. Active substances of the formulation in parts by weight
    10 Maleic acid mono-2-ethylhexylamide
    30 Diethanolamine
    5 Caprylic acid
    3 1-Hydroxyethane-1,1-diphosphonic acid, 60%
    2 nonionic surfactant (product of addition of ethylene oxide to polyethylene glycol)

It is claimed:

1. Method for passivating iron and steel surfaces with the aid of aqueous, alkaline reacting solutions which contain corrosion inhibitors, consisting essentially in that the metal surface is treated with solutions which contain from 0.5% to 5% by weight of a combination, giving a clear solution in water, of
    (a) one or more maleic acid monoalkylamides having from 6 to 14 carbon atoms in said monoalkyl,
    (b) one or more alkanolamines having from 2 to 12 carbon atoms,
    (c) one or more phosphonic acids which have complexing properties, the weight ratio of maleic acid monoalkylamide to alkanolamine being 1:0.3 to 1:10 and the weight ratio maleic acid monoalkylamide to phosphonic acid being 1:0.01 to 1:0.5 and the pH value of the solution being between 7.5 and 10.5.

2. Method according to claim 1, wherein the metal surface is treated with a solution which contains maleic acid mono-n- or iso-alkylamides with 8 to 10 carbon atoms in the alkyl.

3. Method according to claim 1 or 2 wherein the metal surface is treated with a solution which contains an alkanolamine selected from the group consisting of mono-, di- and triethanolamine.

4. Method according to claim 1 or 2 wherein the metal surface is treated with a solution which contains a phosphonic acid selected from the group consisting of 1-hydroxyalkyl-1,1-diphosphonic acid, 1-aminoalkyl-1,1-diphosphonic acid, phosphonocarboxylic acid and a phosphonic acid of the formula:

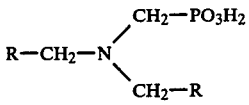

in which

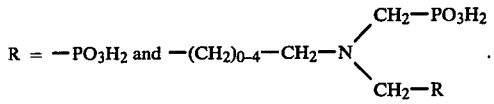

5. Method according to claim 4 wherein the metal surface is treated with a solution which contains a phosphonic acid selected from the group consisting of 1-hydroxyethane-1,1-diphosphonic acid, 2-phosphonobutane-1,2,4-tricarboxylic acid and nitrilotrimethylene phosphonic acid.

6. A composition for the passivation of iron and steel surfaces consisting essentially of an aqueous alkaline solution having a pH of from 7.5 to 10.5 containing from 0.5% to 5% by weight of the total weight of a corrosion inhibitor combination, giving a clear solution in water, of:

(a) one or more maleic acid monoalkylamides having from 6 to 14 carbon atoms in said monoalkyl, (b) one or more alkanolamines having from 2 to 12 carbon atoms, (c) one or more phosphonic acids which have complexing properties, the weight ratio of maleic acid monoalkylamide to alkanolamine being 1:0.3 to 1:10 and the weight ratio maleic acid monoalkylamide to phosphonic acid, 1:0.01 to 1:0.5.

7. The composition according to claim 6, wherein it contains maleic acid mono-n- or isoalkylamides with 8 to 10 carbon atoms.

8. The composition according to claim 6 or 7 wherein said alkanolamine is selected from the group consisting of mono-, di- and tri-ethanolamine.

9. A composition according to claim 6 or 7 wherein said phosphonic acid is selected from the group consisting of 1-hydroxyalkyl-1,1-diphosphonic acid, 1-aminoalkyl-1,1-diphosphonic acid, phosphonocarboxylic acid and a phosphonic acid of the formula:

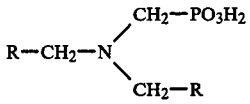

in which

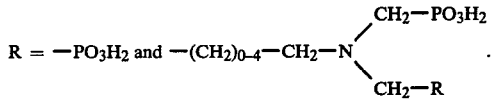

10. A composition according to claim 6 or 7 wherein said phosphonic acid is selected from the group consisting of 1-hydroxyethane-1,1-diphosphonic acid, 2-phosphonobutane-1,2,4-tricarboxylic acid and nitrilotrimethylene phosphonic acid.

11. A composition according to claim 6 or 7 wherein the weight ratio maleic acid monoalkylamide to alkanolamines is 1:1 to 1:4.

12. A composition according to claim 6 or 7 wherein the weight ratio maleic acid monoalkylamide to phosphonic acid is 1:0.1 to 1:0.5.

13. A composition according to claim 6 or 7 having additionally nonionic surfactants, in quantities of 0.005 to 0.3%, based on the aqueous solution.

14. A composition according to claim 6 or 7 having additionally builders selected from the group consisting of phosphates and borates, in quantities of 0.2 to 2%, based on the aqueous solution.

* * * * *